US007375466B2

(12) United States Patent
Kwon et al.

(10) Patent No.: US 7,375,466 B2
(45) Date of Patent: May 20, 2008

(54) ADDRESS ELECTRODE DESIGN IN A PLASMA DISPLAY PANEL

(75) Inventors: Jae-Ik Kwon, Asan-si (KR); Tae-Kyoung Kang, Asan-si (KR); Eun-Gi Heo, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 518 days.

(21) Appl. No.: 10/932,259

(22) Filed: Sep. 2, 2004

(65) Prior Publication Data

US 2005/0046353 A1 Mar. 3, 2005

(30) Foreign Application Priority Data

Sep. 2, 2003 (KR) ..... 10-2003-0061191

(51) Int. Cl.
*H01J 17/49* (2006.01)

(52) U.S. Cl. ..... 313/584; 313/585; 313/586; 345/60

(58) Field of Classification Search ..... 313/582–587; 345/60

See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,229,261 | B1 * | 5/2001 | Kim | 313/586 |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,744,203 | B2 * | 6/2004 | Jeong et al. | 313/587 |
| 2003/0184226 | A1 * | 10/2003 | Setoguchi et al. | 313/584 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Karabi Guharay
(74) *Attorney, Agent, or Firm*—Robert E. Bushnell, Esq.

(57) ABSTRACT

A plasma display panel where the address electrodes are designed to have perforated portions in the vicinity of display electrodes to prevent the build up of unwanted wall charges in the vicinity of the display electrodes to thus prevent mis-discharge in the plasma display panel. The perforations can be quadrilateral in shape, and can be made to different sizes depending on the color of the phosphor in the vicinity of the perforation. As a result, drive voltage margin quality between the different colors can be improved to produce a more reliable display.

11 Claims, 4 Drawing Sheets

U.S. PATENT DOCUMENTS

| | | | | |
|---|---|---|---|---|
| 2004/0212303 | A1* | 10/2004 | Kao et al. | 313/582 |
| 2005/0122045 | A1* | 6/2005 | Sung et al. | 313/582 |
| 2006/0113914 | A1* | 6/2006 | Fujitani et al. | 313/586 |

FOREIGN PATENT DOCUMENTS

| | | | |
|---|---|---|---|
| JP | 2845183 | | 10/1998 |
| JP | 2917279 | | 4/1999 |
| JP | 2001-043804 | | 2/2001 |
| JP | 2001-325888 | | 11/2001 |
| KR | 1020000055961 | A | 9/2000 |
| KR | 1020030013036 | A | 2/2003 |

* cited by examiner

ADDRESS ELECTRODE DESIGN IN A PLASMA DISPLAY PANEL

CLAIM OF PRIORITY

This application makes reference to and claims all benefits accruing under 35 U.S.C. § 119 from an application for PLASMA DISPLAY DEVICE earlier filed in the Korean Intellectual Property Office on the 2nd day of Sep. 2003 and there duly assigned Serial No. 2003-61191.

BACKGROUND OF THE INVENTION

1. Field of the Invention

The present invention relates to a plasma display panel (or PDP), and more particularly, to an address electrode structure of a plasma display panel.

2. Description of the Related Art

A PDP is typically a display device in which ultraviolet rays generated by the discharge of gas excite phosphors to realize predetermined images. With its ability to realize high-resolution images, the PDP is emerging as one of the most popular flat panel display configurations used for wall-mounted televisions and other similar large-screen applications.

When voltages are applied to the display and the address electrodes in a PDP, a charge and hence a space voltage forms near both the scan electrode and the display electrode on the substrates. An opposite charge is also formed on the lower substrate near the address electrode opposite to the scan electrode. These charges are free to move about and can accumulate about the display electrode. On the upper substrate, this charge that develops about the display electrode is of opposite polarity to the charge built up about the scan electrode and thus this charge built up about the display electrode serves to disturb the magnitude of the wall voltage, thus decreasing the quality of the image displayed. Therefore, what is needed is a design for a PDP that reduces or eliminates this build up of charge on the upper substrate in the vicinity of the display electrode.

SUMMARY OF THE INVENTION

It is therefore an object of the present invention to overcome the above problem.

It is also an object of the present invention to provide an improved design for a plasma display panel that overcomes the above problem.

It is further an object to provide methods for forming the improved plasma display panel.

These and other objects can be achieved by a plasma display panel that modifies the design of the plasma display panel to reduce the space charge build up in the vicinity of the display electrode. This can be achieved by changing the design of the address electrodes so that the address electrodes are perforated by holes. These perforations are formed at locations on the address electrodes nearest to the display electrodes and serve to reduce wall charge built up near the display electrodes.

The holes in the address electrodes can be made simultaneously with the formation of the address electrodes via screen printing or by photolithography. Further, the address electrodes can be formed first and then the perforations in the address electrodes can be formed by etching after the address electrodes are formed.

The perforations in the address electrodes are preferably quadrilateral in shape. Preferably, the longest two sides of the quadrilateral are parallel to the direction of the address electrodes. Preferably, the sizes of the perforations vary depending on the color of the phosphors in the particular discharge cell the perforation is closest to. Thus, for green discharge cells, the holes are the biggest and for red discharge cells, the holes are the smallest and for blue discharge cells, the holes are in between that for red and for green discharge cells. Preferably, the size of the holes in the address electrodes are varied by varying the lengths of the widths or the shortest two sides of the quadrilateral.

Each of the discharge sustain electrodes includes a display electrode and a scan electrode, and the windows or holes of the non-conducting segments of the address electrodes are formed in areas corresponding to the display electrodes and not corresponding to the scan electrodes. The windows of the non-conducting segments may be formed within discharge regions of the plasma display panel, or may extend to non-discharge regions.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
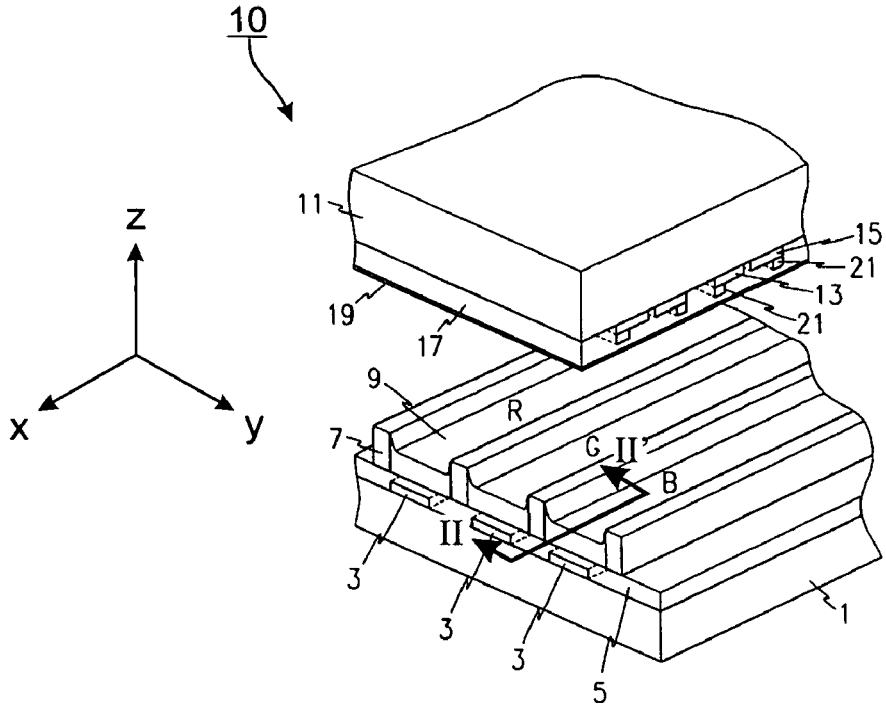
FIG. 1 is a partial exploded perspective view of a plasma display panel.
Figure 2:
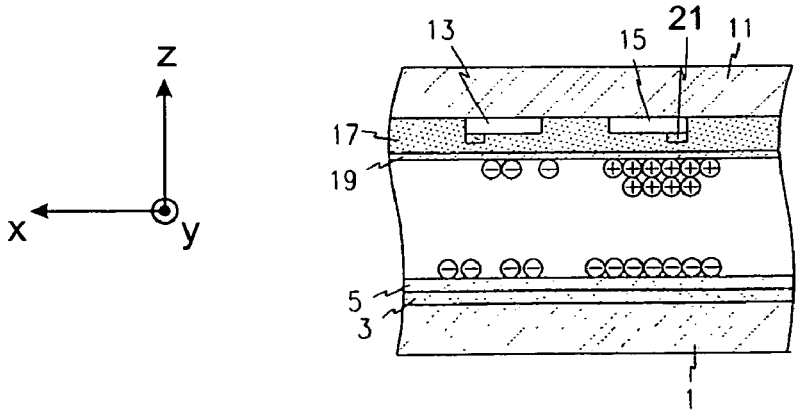
FIG. 2 is a partial sectional view of the plasma display panel of FIG. 1 in an assembled state.

Turning now to the figures, FIG. 1 illustrates an exploded perspective view of a triode surface discharge PDP 10, and FIG. 2 is a partial sectional view of the PDP 10 in an assembled state and taken along the II-II' direction in FIG. 1 and looking in the −y-direction. As illustrated in FIG. 1, address electrodes 3 are arranged in a striped pattern along the +/−x-direction on a lower substrate 1. A dielectric layer 5 is formed over an entire surface of the lower substrate 1 on which the address electrodes 3 are formed such that the dielectric layer 5 covers the address electrodes 3. Barrier ribs 7 are formed on the dielectric layer 5 in a striped pattern in the +/− x-direction parallel to and between the address electrodes 3. Formed between the barrier ribs 7 are R, G, and B phosphor layers 9 on which R, G, and B phosphors are deposited. Between adjoining barrier ribs 7 are discharge cells. Preferably, each discharge cell contains phosphor of a single color, either R, G or B, so that phosphor of different colors do not mix with each other or come into contact with each other.

Formed in a +/− y-direction on a surface of an upper substrate 11 that faces lower substrate 1 are discharge sustain electrodes, that include display electrodes 13 and scan electrodes 15. The display electrodes 13 and scan electrodes 15 are arranged in a striped pattern parallel to each other and are preferably formed orthogonal to the address electrodes 3. A transparent dielectric layer 17 is formed over the display electrodes 13 and the scan electrodes 15, and an MgO protection layer 19 is formed over the dielectric layer 17.

The display electrodes 13 and the scan electrodes 15 are preferably made of ITO (indium tin oxide) having transparent characteristics to allow the transmission of light from the illumination of the phosphor layers 9. Since ITO has low conductivity, bus electrodes 21 made of a metal material are formed on the display electrodes 13 and on the scan electrodes 15 to increase the conductivity of these elements.

After assembling the upper substrate 11 to the lower substrate 1 structured as described above, discharge gas is filled in discharge spaces (or discharge cells) defined by the barrier ribs 7. Each cell is bounded on one side by an address electrode 3 and on the other side by one of the display electrode 13 and scan electrode 15 opposing this address electrode 3. The process of selecting one of the cells to realize gas discharge will be described below.

If an address voltage Va is applied between the address electrodes 3 and the scan electrodes 15 during the address interval, plasma is formed in the corresponding discharge space, and electrons in the plasma and ions move toward the dielectric layer having an opposite polarity to be accumulated on the corresponding dielectric layer 5 or 17 and thus complete address discharge. Charges accumulated on the transparent dielectric layer 17 of the upper substrate 11 during this process are referred to as wall charges, and a space voltage effected by this wall charge is referred to as a wall voltage Vw. This accumulation of the wall charge occurs during the address interval where a potential difference Va is applied between the address electrodes 3 and the scan electrodes 15.

Following the address interval is the sustain interval where a discharge sustain voltage Vs is applied between the display electrodes 13 and the scan electrodes 15 such that a sum of the wall voltage Vw and the discharge sustain voltage Vs exceeds a discharge firing voltage Vf. When this occurs, vacuum ultraviolet rays are emitted by plasma discharge to excite the phosphor layers 9 and thus complete sustain discharge.

In the PDP 10 as structured and operating as in the above, selective discharge is realized in an address interval and in cells where a wall charge is generated on the transparent dielectric layer 17 of the upper substrate 11. Ideally, charges generated by plasma discharge in the address interval are accumulated only on the dielectric layer 5 of the lower substrate 1 and on the dielectric layer 17 in the vicinity of the scan electrodes 15 of the upper substrate 11 and not in the vicinity of the display electrodes 13. However, in reality, the charges(−) adhered to the dielectric layer 5 of the lower substrate 1 across from the scan electrodes 15 freely move within the discharge spaces as a result of the polarity(+) of the address electrodes 3 enabling some of these (−) charges to migrate and then accumulate on the surface of the transparent dielectric layer 17 in the vicinity of the display electrodes 13.

The polarity(−) of the wall charges accumulated on the transparent dielectric layer 17 in the vicinity of the display electrodes 13 of the upper substrate 11 are opposite in polarity to the polarity(+) of the wall charges accumulated on the transparent dielectric layer 17 in the area of the scan electrodes 15. By having these (−) charges accumulate on dielectric layer 17 in the vicinity of the display electrodes 13, the resultant wall voltage of the transparent dielectric layer 17 covering the display electrodes 13 and the scan electrodes 15 increases from what it would have been if no (−) charge were to accumulate on dielectric layer 17 in the vicinity of the display electrodes 13. Therefore, if the discharge sustain voltage Vs is applied between the display electrodes 13 and the scan electrodes 15 after the address interval, discharge occurs before all the charge conditions have been met as a result of the increased wall voltage, thereby causing mis-discharge in the display cells.

Figure 3:
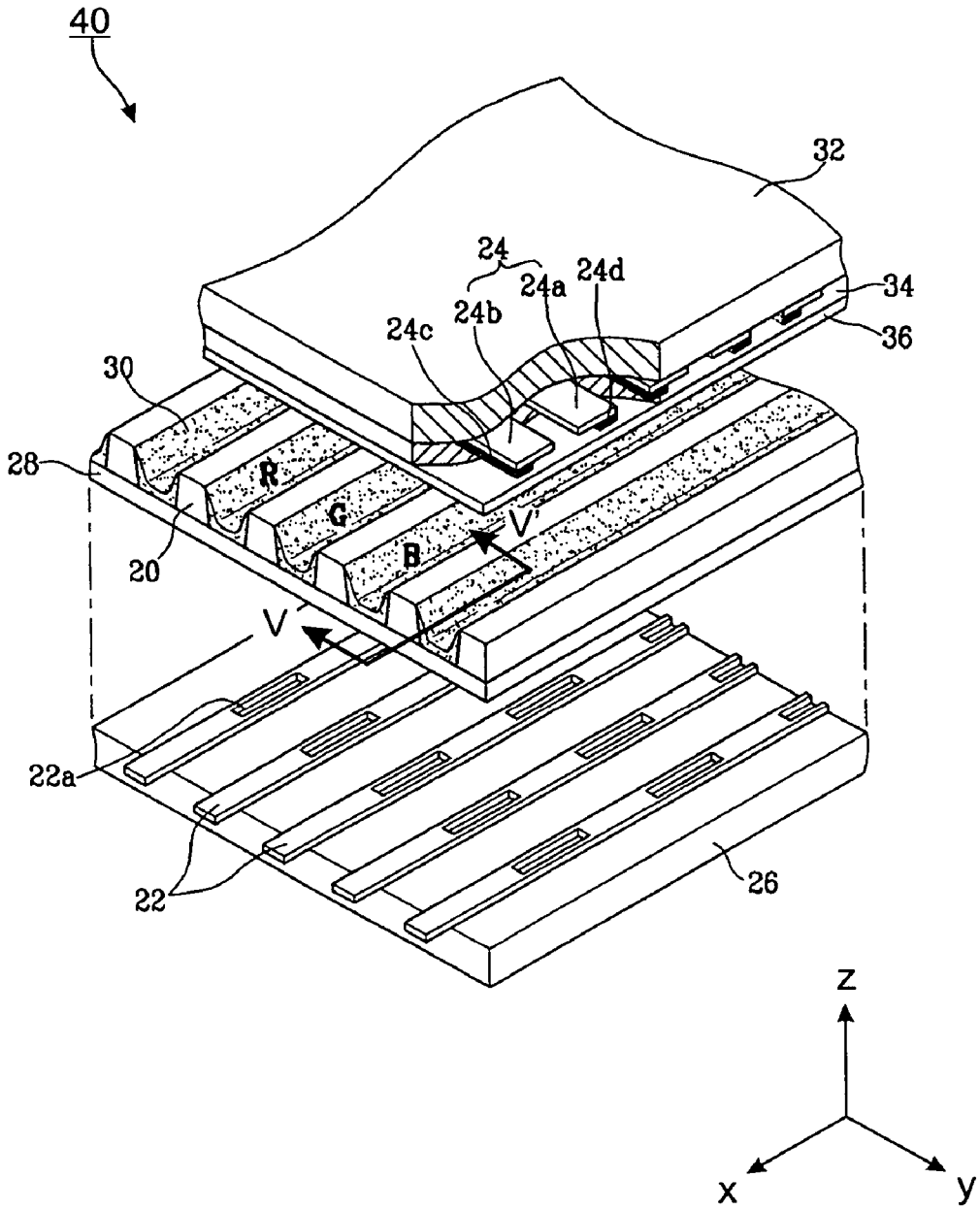
FIG. 3 is a partial exploded perspective view of a plasma display panel according to an exemplary embodiment of the present invention.

FIG. 3 is a partial exploded perspective view of a plasma display panel (PDP) 40 according to an exemplary embodiment of the present invention. The PDP 40 of the exemplary embodiment of the present invention is of a triode surface discharge type PDP in which discharge spaces (or discharge cells) are defined by barrier ribs 20 formed in a striped pattern. An address electrode 22 and a pair of discharge sustain electrodes 24, that is, a display electrode 24*a* and a scan electrode 24*b*, are provided for each cell such that illumination for each cell is independently controlled.

A plurality of address electrodes 22 are arranged in a striped pattern on a first substrate (hereinafter referred to as a "lower substrate") 26 along a +/− x-direction thereof. A dielectric layer 28 is formed over an entire surface of the lower substrate 26 on which the address electrodes 22 are formed such that the dielectric layer 28 covers the address electrodes 22. Barrier ribs 20 of a predetermined height are formed on the dielectric layer 28 in a striped pattern in the +/− x-direction parallel to the address electrodes 22 and in an alternating manner with the address electrodes 22. Formed between the barrier ribs 20, that is, in discharge spaces defined by the barrier ribs 20, are R, G, and B phosphor layers 30. Although R, G and B color scheme is described, the present invention can also work with other color schemes such as Cyan, Magenta and Yellow. Preferably, each discharge cell has just one color of phosphor in it so that phosphor layers of different colors never mix and never contact one another.

Formed on a surface of a second substrate (hereinafter referred to as an "upper substrate") 32 that faces the lower substrate 26 and along a +/− y-direction that is substantially perpendicular to the address electrodes 22 are formed the discharge sustain electrodes 24. The discharge sustain electrodes 24 include display electrodes 24*a* and scan electrodes 24*b* formed in an alternating manner. The display electrodes 24*a* and scan electrodes 24*b* are arranged in a striped pattern parallel to each other. The discharge sustain electrodes 24 also include bus electrodes 24*c* and 24*d* formed on the scan electrodes 24*b* and display electrodes 24*a*, respectively. The bus electrodes 24*c* and 24*d* are made of a metal material while the display and scan electrodes 24*a* and 24*b* are made of a more resistive but transparent material such as ITO. The bus electrodes 24*c* and 24*d* are used to increase the conductivity of along the scan electrodes 24*b* and display electrodes 24*a*. A dielectric layer 34 is formed covering the discharge sustain electrodes 24, and then an MgO protection layer 36 is formed covering the dielectric layer 34.

In the novel PDP 40, the address electrodes 22 are perforated by one or more non-conducting segments 22*a* formed in each address electrode 22 at areas corresponding to the location of the display electrodes 24*a*. The non-conducting segments 22*a* prevent the generation of wall charges in the areas of the display electrodes 24*a* during address intervals.

The non-conducting segments (or holes or windows) 22*a* are formed as windows in which a predetermined amount of an inner area of the address electrodes 22 is removed to form the holes 22*a*. For each of the address electrodes 22, one of the non-conducting segments 22*a* is formed at areas where corresponding display electrodes 24*a* intersect the particular address electrode 22. The non-conducting segments 22*a* are preferably formed to have a quadrilateral shape. Although the holes 22*a* are depicted as rectangular in the figures, in no way is the present invention limited to any particular shape of the hole. Further, instead of perforating the address electrodes 22 with holes, it is also possible to instead just make the address electrodes narrower in the vicinity of the display electrodes 24*a* so that the cross sectional area of the address electrodes is reduced near display electrodes 24*a*.Therefore, although perforations or windows are illustrated, in no way is the present invention limited thereto as a cut out of an edge portion of the address electrodes in the vicinity of the display electrodes can be employed instead.

Figure 4:
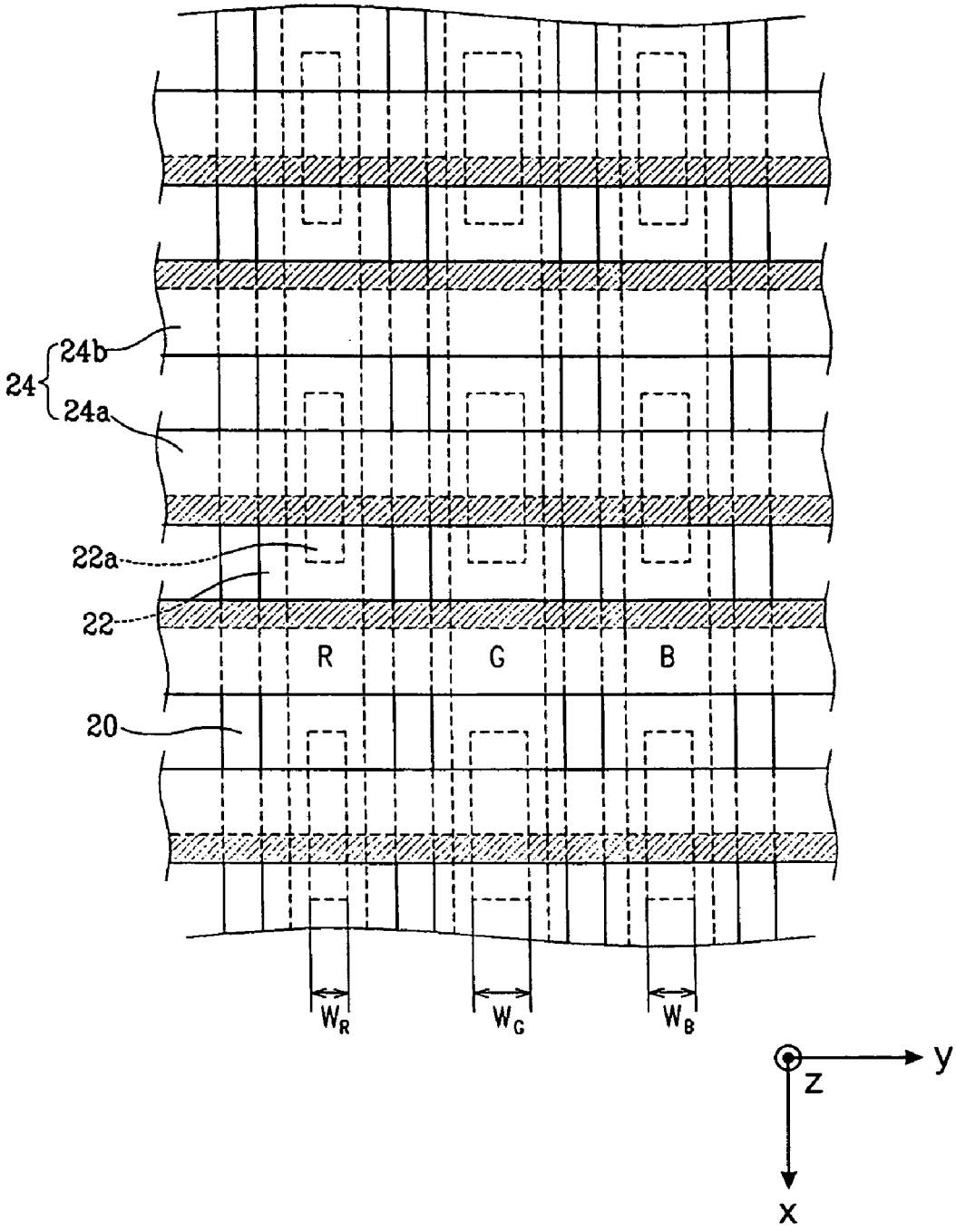
FIG. 4 is a partial plan view used to describe the relationship in the arrangement between the address electrodes and discharge sustain electrodes in the plasma display panel of FIG. 3.

Turning now to FIG. 4, FIG. 4 illustrates the spatial interrelationship of each of the electrodes in the PDP 40 of FIG. 3 looking down in a −z-direction. As illustrated in FIG. 4, the PDP display 40 is formed so that the display electrodes 24*a* overlap portions of the address electrodes 22 that are perforated by the non-conducting segments 22*a* in the address electrodes 22. Also illustrated in FIG. 4 is the scan electrodes 24*b* overlapping portions of the address electrodes between the non-conducting segments 22*a*.

The non-conducting segments 22*a* are formed within the discharge space regions of the PDP 40, or may extend into non-discharge regions of the PDP 40. In this exemplary embodiment, the quadrilateral shape of the non-conducting segments 22*a* is merely for illustrative purposes and it is possible to use other shapes as deemed necessary.

Preferably, the non-conducting segments 22*a* are formed in a fixed number of sizes such as two or three different sizes. In other words, it is preferable not to have all of the perforations 22*a* in address electrodes 22 in PDP 40 having different sizes and it is also not preferable to have all of the perforations 22*a* in address electrodes 22 in a PDP 40 to all have the same size. Preferably, the sizes of the non-conducting segments 22*a* are varied depending on the color of the phosphor layer in the discharge cell over the non-conducting segment 22*a*. Preferably, the non-conducting segments 22*a* corresponding to the green phosphor layers 20 are formed to have the largest size, the non-conducting segments 22*a* corresponding to the blue phosphor layers 20 are formed to the next biggest size, and the non-conducting segments 22*a* corresponding to the red phosphor layers 20 are formed to have the smallest size.

The size of the non-conducting segments 22*a* may be varied by varying their widths $W_R$, $W_G$, and $W_B$, where $W_R$ is the width of the non-conducting segments 22*a* corresponding to the red phosphor layers 20, $W_G$ is the width of the non-conducting segments 22*a* corresponding to the green phosphor layers 20, and $W_B$ is the width of the non-conducting segments 22*a* corresponding to the blue phosphor layers 20.

The address electrodes 22 perforated by the windows of the non-conducting segments 22*a* may be formed using a conventional print method. During manufacture of the address electrodes 22, a screen mesh may be used having a pattern that corresponds to the windows of the non-conducting segments 22*a*. Alternatively, the windows 22*a* can be formed via photolithography, either simultaneous to or after the formation of the address electrodes 22.

In the PDP 40 described above having address electrodes 22 perforated by holes 22*a*, if an address voltage Va is applied between the address electrodes 22 and the scan electrodes 24*b* during the address interval, plasma is formed in the discharge spaces, and electrons and ions in the plasma move toward the electrodes that have an opposite polarity.

Figure 5:
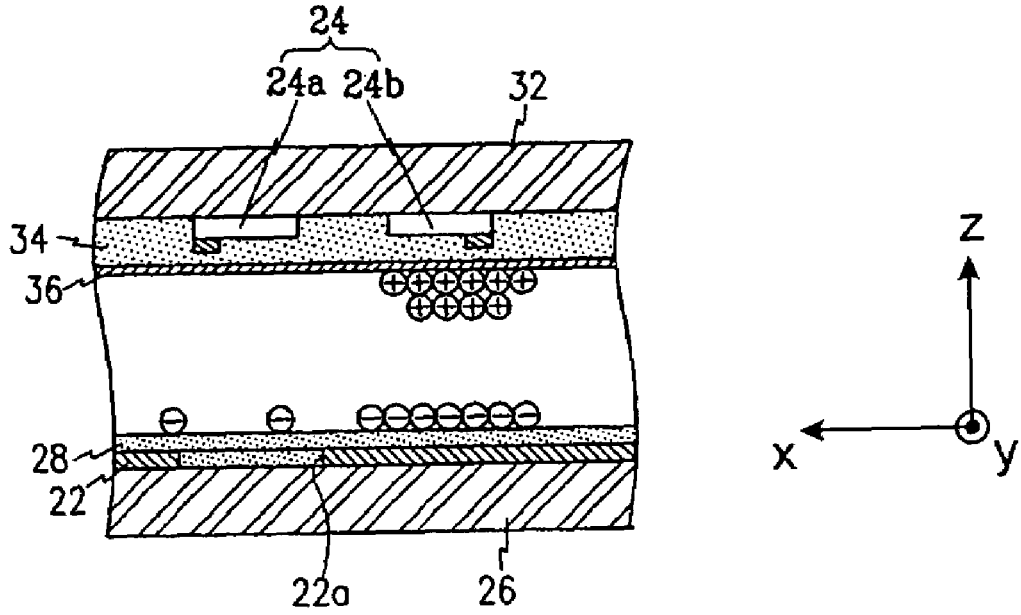
FIG. 5 is a partial sectional view of the plasma display panel of FIG. 3 in an assembled state.

Turning to FIG. 5, FIG. 5 illustrates a cross section of PDP 40 of FIG. 3 taken along V-V' and looking in a −y-direction. The sectional view of FIG. 5 illustrates how the charges group in PDP 40 when the address electrodes 22 are perforated by holes 22*a*. As illustrated in FIG. 5, a charge with a (−) polarity is accumulated on the dielectric layer 28 that covers the address electrodes 22, and a charge with a (+) polarity is accumulated on the dielectric layer 34 covering the scan electrodes 24*b*.

Areas of the address electrodes 22 opposing the display electrodes 24*a* are reduced because of the presence of the non-conducting segments 22*a* perforating address electrodes 22 at these locations. This hole 22*a* in the address electrode 22 reduces the amount of charge accumulated on the dielectric layers 28 and 34 in the vicinity of the display electrodes 24*a*. As a result, charges generated during the address interval are accumulated in a more concentrated manner on the dielectric layers 28 and 34 at areas in the vicinity of the scan electrodes 24*b* and not in the vicinity of the display electrodes 24*a*.

The non-conducting segments 22*a* not only prevent the accumulation of charges on the surfaces of the dielectric layers 28 and 34 in areas corresponding to the display electrodes 24*a*, but also prevent the charges accumulated on the dielectric layer 28 of the lower substrate 26 from migrating toward the display electrodes 24*a* to thus effectively prevent the generation of wall charges on the dielectric layer 34 of the upper substrate 32 in the vicinity of the display electrode 24*a*.

As a result, in the process of applying a discharge sustain voltage Vs between the scan electrodes 24*b* and the display electrodes 24*a* during a sustain interval to perform selection and discharge of a display cell, wall charges are prevented from being accumulated in the vicinity of the display electrodes 24*a*. Hence, a discrepancy between a wall voltage predicted during design and an actual wall voltage resulting from the application of an address voltage is minimized.

In the PDP 40 structured as in the above, the possibility of mis-discharge is reduced and only designated display cells are precisely illuminated during sustain intervals. Furthermore, the sizes of the non-conducting segments 22*a* are varied according to R, G, B discharge cell characteristics (a drive voltage margin) such that mis-discharge is further prevented. That is, discharge cells of green phosphor layers in the a PDP exhibit lower drive margin characteristics compared to the other cells. As a result, in the present invention, the non-conducting segments 22*a* formed in the vicinity of the discharge cells lined with green phosphor layers 20 are larger compared to the non-conducting segments 22*a* formed in areas corresponding to the red and/or blue discharge cells so that this low drive margin for the green cell is not violated. This results in the operation of the non-conducting segments 22*a* being more effectively realized with respect to the discharge cells of the green phosphor layers 20 to thereby make the overall drive voltage margin characteristics substantially identical for the different colors.

In the PDP 40 of the present invention, a plurality of the non-conducting segments 22*a* are formed in the address electrodes 22 such that wall charges are prevented from accumulating in the vicinity of the display electrodes 24*a* so that mis-discharge of display cells caused by an improper wall charge is prevented. As a result, only designated display cells are precisely selected to undergo discharge during sustain intervals resulting in an improved reliability of the device, so that the drive conditions are stabilized. Further, by having perforations 22*a* of different sizes for different colors of phosphor layers, the differences in drive voltage margin characteristics with respect to the different R, G, and B discharge cells are minimized to further the overall display quality of the PDP.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing one another with a predetermined gap therebetween;

a plurality of address electrodes formed on the first substrate;

a dielectric layer formed on the first substrate covering the address electrodes;

barrier ribs mounted on the dielectric layer at a predetermined height, the barrier ribs defining discharge spaces over each of the address electrodes;

R, G, and B phosphor layers formed in the discharge spaces;

a plurality of discharge sustain electrodes formed on a surface of the second substrate opposing the first substrate and along a direction substantially perpendicular to the address electrodes; and a dielectric layer formed over an entire surface of the second substrate covering the discharge sustain electrodes, a non-conducting segment being formed in an area of each of the address electrodes opposing the discharge sustain electrodes, the non-conducting segments having different sizes depending upon the color of the phosphor layer closest to the non-conducting segment.

2. The plasma display panel of claim 1, the different sizes of the non-conducting segments being achieved by varying a width of the non-conducting segments.

3. The plasma display panel of claim 2, wherein the windows of the non-conducting segments are formed as quadrilateral shapes.

4. The plasma display panel of claim 2, wherein the plurality of discharge sustain electrodes comprises a display electrodes and a scan electrodes formed in an alternating manner, and the windows of the non-conducting segments are formed only in areas corresponding to the display electrodes.

5. The plasma display panel of claim 4, wherein the windows of the non-conducting segments are formed within discharge regions of the plasma display panel.

6. The plasma display panel of claim 5, wherein the windows of the non-conducting segments are extended to non-discharge regions.

7. A plasma display panel, comprising:

a first substrate and a second substrate opposing one another with a predetermined gap therebetween;

a plurality of address electrodes formed on the first substrate;

a dielectric layer formed on the first substrate covering the address electrodes;

barrier ribs mounted on the dielectric layer at a predetermined height, the barrier ribs defining discharge spaces over each of the address electrodes;

R, G, and B phosphor layers formed in the discharge spaces;

a plurality of discharge sustain electrodes formed on a surface of the second substrate opposing the first substrate and along a direction substantially perpendicular to the address electrodes; and a dielectric layer formed over an entire surface of the second substrate covering the discharge sustain electrodes, a non-conducting segment being formed in an area of each of the address electrodes opposing the discharge sustain electrodes, the non-conducting segments having different sizes, the non-conducting segments are formed by removing an inner portion of the address electrodes to realize a window configuration, the plurality of address electrodes being perforated by windows of the non-conducting segments of at least two different sizes corresponding to the R, G, and B phosphor layers.

8. The plasma display panel of claim 7, wherein the windows of the non-conducting segments corresponding to the G phosphor layers are the largest.

9. A plasma display panel, comprising:

a first substrate and a second substrate facing the first substrate and separated from the first substrate by a predetermined gap;

a plurality of address electrodes formed on the first substrate in a first direction;

a dielectric layer formed on the first substrate covering the address electrodes;

barrier ribs mounted on the dielectric layer at a predetermined height, the barrier ribs defining discharge spaces over each of the address electrodes;

R, G, and B phosphor layers formed in the discharge spaces;

a plurality of discharge sustain electrodes that includes a plurality of scan electrodes and a plurality of display electrodes that vary in an alternating manner and are arranged on a surface of the second substrate that faces the first substrate and extending in a second direction substantially perpendicular to the first direction; and a dielectric layer formed over an entire surface of the second substrate covering the discharge sustain electrodes, said address electrodes having wide portions and narrow portions between corresponding the wide portions, each of said narrow portions being arranged at locations on the address electrodes that are closest to ones of the plurality of display electrodes, each of the narrow portions having widths that vary depending upon which of the R, G and B phosnhor layers is arranged closest to it.

10. The display of claim 9, said narrow portions having two widths, a smaller first width and a larger second width, the smaller first width being only in the vicinity of discharge spaces comprising G phosphor.

11. The display of claim 9, said narrow portions having two widths, a smaller first width and a larger second width, the larger second width being only in the vicinity of discharge spaces comprising R phosphor.

* * * * *